United States Patent [19]

Surti

[11] Patent Number: 4,826,334

[45] Date of Patent: May 2, 1989

[54] ENDLESS LOOP RIBBON CASSETTE WITH ORDERED STORAGE

[76] Inventor: Tyrone N. Surti, 424 Harding Industrial Dr., Nashville, Tenn. 37211

[21] Appl. No.: 101,569

[22] Filed: Sep. 25, 1987

[51] Int. Cl.[4] ..... B41J 32/02

[52] U.S. Cl. ..... 400/196.1; 400/208; 400/224; 400/235

[58] Field of Search ..... 400/194, 195, 196, 196.1, 400/207, 208, 208.1, 224, 235, 235.1, 635; 226/170, 171; 242/192

[56] References Cited

U.S. PATENT DOCUMENTS 4,209,261 6/1980 Bell et al. ..... 400/196.1
4,210,403 7/2980 Mazouet et al. ..... 400/196.1
4,467,976 8/1984 Bogaczyk et al. ..... 400/208 X
4,493,572 1/1985 Van Ocker et al. ..... 400/208 X
4,650,354 3/1987 Morarka et al. ..... 400/208 X

FOREIGN PATENT DOCUMENTS 107877 7/1982 Japan ..... 400/195

*Primary Examiner*—Charles Pearson
*Attorney, Agent, or Firm*—C. A. Phillips

[57] ABSTRACT

An endless loop ribbon cassette wherein the storage of a ribbon in a ribbon cassette is effected by a belt assembly which causes the ribbon to move along a generally linear path substantially corresponding to one dimension of a storage cavity. This effects an ordered, rather than a random, storage of a ribbon. In addition, a ribbon is obliquely positioned with respect to a line of print of a printer with which a cassette is to be used.

7 Claims, 3 Drawing Sheets

ENDLESS LOOP RIBBON CASSETTE WITH ORDERED STORAGE

TECHNICAL FIELD

This invention relates generally to printing ribbon holders and particularly to an endless loop-type ribbon cassette.

BACKGROUND OF THE INVENTION

It is common practice today to employ a ribbon cassette carrying an endless ribbon as an ink source for typewriters and computer driven printers, the latter typically being of either the dot matrix or printwheel type. One method of storing such a ribbon has been randomly stuffing it into a chamber of a cassette. This often results in an extremely high number of bends or creases in the ribbon, this occurring at repeated distances on the order of one-quarter inch or less. Thus, with a typical 360-inch length ribbon, there may be on the order of 1,440 bends or creases. It is to be appeciated that this has two distinct disadvantages. One is that an impact of a print head through a crinkled ribbon will produce uneven print. The second disadvantage is that each bend or crease in a ribbon consumes extra storage space and thus the storage capacity for ribbon is diminished.

Another method of storing such ribbon in a cassette is by directing the ribbon into a storage cavity where it is stored in orderly arranged folds. Typically, the ribbon is routed through adjacent feed rollers or drive wheels which grip the ribbon therebetween and direct the ribbon into a storage compartment in the casette where it is stored in folded relation.

In addition to the employment of devices for directing a ribbon into a storage compartment of a cassette, certain cassettes are configured to direct ribbon across the print head of the printer along a line which is at a small angle, for example, 2°, with the base line of printing of a print head. The reason for this is that there is less tendency for repetitive striking of an area of a ribbon by a print head and thus less wear on the ribbon. This in turn enables a greater number of cycles of use of a given length of ribbon. In the patent to David W. Bell et al., U.S. Pat. No. 4,209,261, issued June 24, 1980, this offset has been accomplished by an intentional angular misalignment between a drive shaft of the host printer and the drive roller assembly of the cassette. In order to accomplish this intentional offset and still allow the ribbon to pass through adjacent drive wheels of the angled roller assembly, the storage compartment is angled between the extreme sides or edges of the cassette body. The storage compartment and ribbon path are disposed in generally parallel relation. While the difference in elevation of the ribbon path at the entrance and exit of the storage compartment has been achieved so that the ribbon is directed across the print head of the printer at an oblique angle with the base line of the print head, the resulting intentional misalignment between the drive roller assembly of the cassette and the drive shaft of the printer may result in undue binding and thus undue wear on both the printer and cassette.

It is the object of this invention to overcome the aforesaid disadvantages and to provide a ribbon cassette which effects an ordered storing of the ribbon with substantially fewer number of bends while eliminating the problem of misalignment between the drive member of the printer and a drive roller of the cassette.

SUMMARY OF THE INVENTION

In accordance with this invention, the ribbon is fed into the storage cavity of the cassette by a drive mechanism which is mounted in the body of the cassette and which includes a drive shaft in axial alignment with the drive shaft of the printer. The cassette includes a pair of spaced horiziontal side sections. One horizontal section supports guide members for the ribbon, and the other horizontal section supports the cassette's drive shaft in axial alignment with the output drive shaft of the printer. Such axial alignment assures that there is no binding between the mating drive shafts. A desired angular offset along the print line is accomplished in the printing region by an offset path between a pair of end guides arranged at the different elevations. Such an offset does not adversely affect the travel of the ribbon and, the ribbon being flexible, has no effect on the mechanism.

BRIEF DESCRIPTION OF THE DRAWINGS

FIG. 7 illustrates the sectional view of the top cover of the cassette body, and FIG. 8 illustrates the sectional view of the base of the cassette body.

DESCRIPTION OF THE PREFERRED EMBODIMENT

Figure 1:
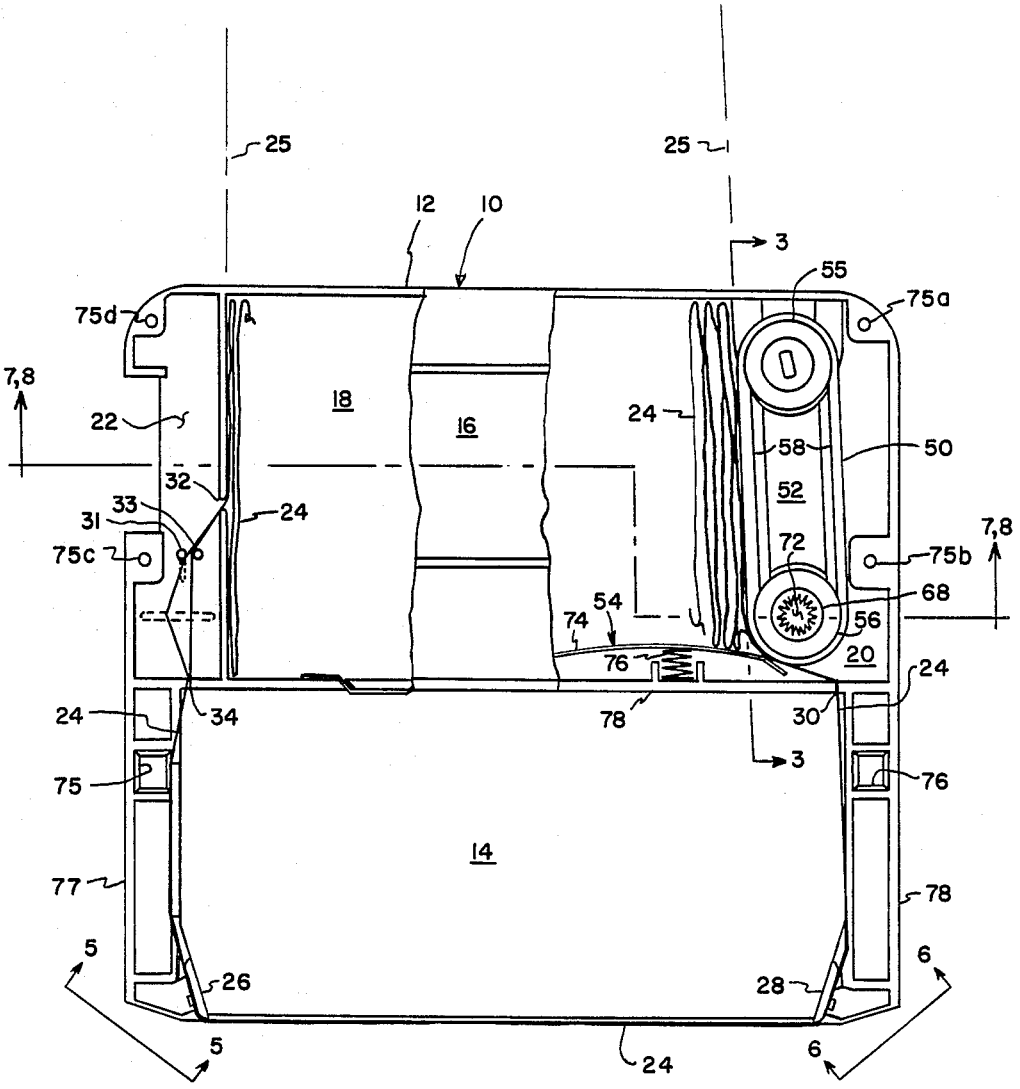
FIG. 1 is a top plan view, partially broken away to show the interior of a ribbon cassette as contemplated by this invention.

Referring to the drawings, ribbon cassette 10 is formed with a molded plastic case 12 in turn formed of a basic enclosure 14 and enclosure cover 16, the two being frictionally fit together in a conventional fashion. Cover 16 fits over and encloses the top half of the cassette as shown in FIG. 1, principally enclosing ribbon storing cavity 18, ribbon entrance region 20, and ribbon exit region 22.

Figure 7:
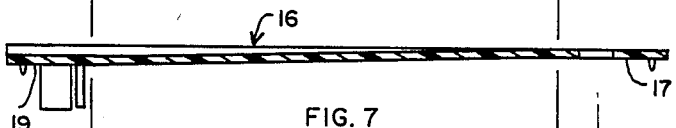
FIGS. 7 and 8 are sectional views taken along lines 7—7 and 8—8 of FIG. 1.
Figure 8:
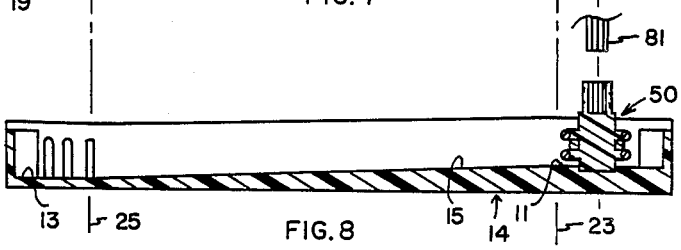

Base 14 (FIGS. 8 and 11) includes a pair of spaced horizontal surfaces 11 and 13 disposed at different elevations adjacent to opposite sides of the casing. An intermediate angled section 15 is disposed between surfaces 11 and 13. In similar manner, cover 16 (FIGS. 7 and 10) includes a pair of spaced inner horizontal surfaces 17 and 19 disposed at different elevations adjacent to opposite sides of the casing and connected by an intermediate angled surface 21. The planes of intersection of the angled and horizontal surfaces are indicated by the numerals 23 and 25 of FIGS. 1 and 9–11.

Figure 4:
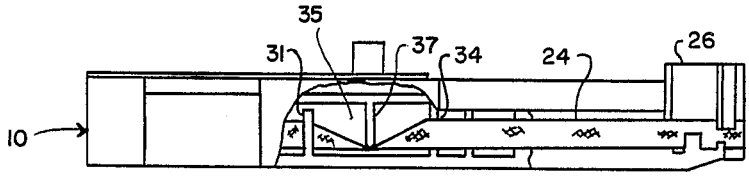
FIG. 4 is a side view as seen from the left side of FIG. 1.

Printing ribbon 24 (FIG. 1) is a continuously inked ribbon, and in operation it extends between guides 26 and 28. The printing process occurs between guides 26 and 28; thereafter, the ribbon passes between guide 28 and cavity entrance 30, through cavity 18 to cavity exit 32. From this point it extends through exit region 22 to exit opening 34. Intermediately, the ribbon extends through guide posts 31 and 33 (FIG. 1) to sloped guide 35 (FIG. 4) which is at a 45° slope, it thus rotates the ribbon 45°. From guide 35 the ribbon extends under horizontal guide 37 (dotted line position in FIG. 1), which is mounted on and extends downward from enclosure cover 16. In this manner, the ribbon is rotated 45°. From guide 37 it is rotated 90° as it is received by exit opening 34 which, as shown, is a vertical slots. Thus, in all, ribbon 24 is rotated 180°, reversed, between cavity exit 32 and exit opening 34. This thus enables the ribbon to be turned over after each pass through the cassette. As a result, it has been found that an approximately 40% longer effective usage can be obtained from a ribbon.

Figure 2:
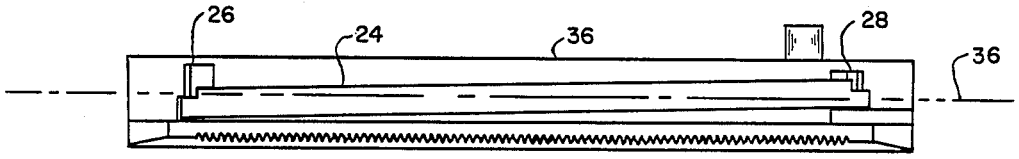
FIG. 2 is a front view, partially broken away, of the ribbon cassette of FIG. 1.

From exit opening 34 the ribbon extends back to and by guide 26 which is at the same elevation as exit opening 34 and at a lower elevation than guide 28. This difference in elevation enables the gradual rise of ribbon 24 from guide 26 to guide 28, being at an oblique angle of approximately 2° with respect to the axis 36 of a line of print, and as best illustrated in FIG. 2.

Figure 5:
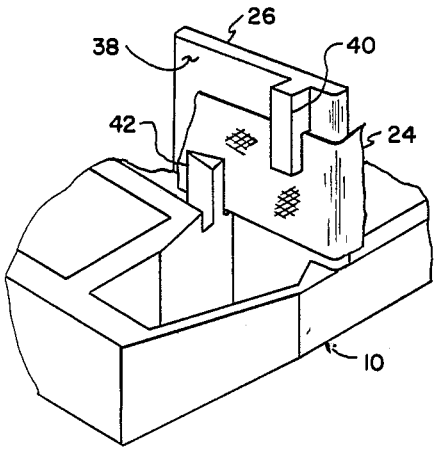
FIG. 5 is an enlarged pictorial fragmentary view as seen along line 5—5 of FIG. 1.

Guide 26 is shown in detail in FIG. 5 and, as shown, ribbon 24 passes over a guide surface 38 and is retained by upper hook 40 and lower hook 42.

Figure 6:
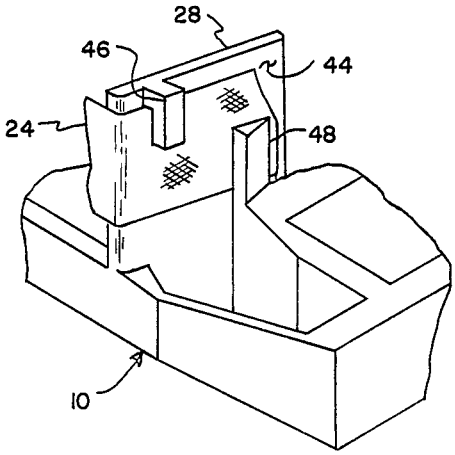
FIG. 6 is an enlarged pictorial fragmentary side view as seen along line 6—6 of FIG. 1.

Guide 28, shown in FIG. 6, is similar to guide 26, ribbon 24 passuing over surface 44 and being retained by upper hook 46 and lower hook 48.

Figure 3:
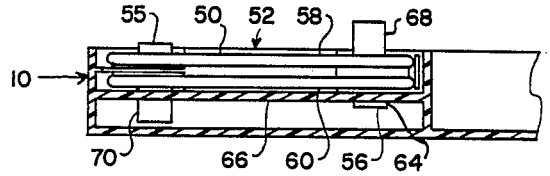
FIG. 3 is a sectional view as seen along line 3—3 of FIG. 1.

From guide 28 the ribbon is drawn through entrance opening 30, then into cavity 18 by ribbon drive 50. In the embodiment shown in FIGS. 1, 3, and 8, the drive consists of belt drive assembly 52 and spring bias assembly 54. Belt drive assembly 52 consists of rollers 55 and 56 mounted on horizontal surface 11 and tubular-shaped belt members 58 and 60 which fit over mating grooves (not shown) in the rollers. Roller 56, which is a drive roller, is supported in an opening (not shown) in top cover 16 and an opening 64 in a lower support member 66 of enclosure 14. Roller 55 is supported by an opening (not shown) in top cover 16 and an opening 70 in support 66. As shown in FIG. 3, a hollow collar 68 of roller 55 extends above cover 16; and, as shown in FIG. 1, the interior 72 of collar 68 has serrations which enable a male driver member from a printer to effect a drive coupling with collar 68 and thus drive roller 56 in the indicated, clockwise, direction.

Ribbon 24 is frictionally driven as it passes across a portion of belts 58 and 60 where belts 58 and 60 rest on roller 55, ribbon 24 being urged against the belts by leaf spring 74 of bias assembly 54. Leaf spring 74 is biased against belts 58 and 60 by a coil spring 76 extending between wall 78 of enclosure 14 and leaf spring 74.

The particular function of ribbon drive 50 is to effect the long folds of ribbon illustrated in FIG. 1 instead of quite short ones typically resulting from conventional random stuffing of a ribbon in a storage cavity. Ribbon 24 has a length of approximately 45 feet which is to be substantially encased in cavity 18, the cavity having a rectangular area of approximately 52 square inches (approximately 2"×2.6"), or approximately nine feet of ribbon per square inch of cavity 18.

Openings 75*a*, 75*b*, 75*c*, and 75*d* are receptacles which receive locking pins (not shown) of cover 16 to effect locking of enclosure cover 16 to enclosure 18. Square members 75 and 76 are employed as structural stiffeners for arms 77 and 78 upon which guides 26 and 28 are mounted.

Initially, a short length of ribbon 24 is placed in the cassette through entrance opening 30, being pulled between leaf spring 74 and belts 58 and 60 and then through openings 32 and 34. Roller 56 is rotated clockwise, stuffing the ribbon randomly in cavity 18 until filled. Once cavity 18 is full, the randomly stuffed ribbon applies pressure against belts 58 and 60, and as additional ribbon is drawn into cavity 18, loops or ribbon are formed which are pressed between the previously stuffed ribbon and belts 58 and 60. This pressing causes the loops formed by new ribbon to be drawn along the length of belts 58 and 60, resulting in the elongated folds shown in FIG. 1. By continuing the process, the earlier formed random folds are allowed to exit until they are exhausted from cavity 18, leaving the long folds of ribbon 24 totally filling cavity 18 and continuing to bias incoming ribbon against the length of belts 58 and 60 as described above. At this point, the ribbon will be maintained as shown as it is cycled through cavity 18 and between guide posts 26 and 28 when in use.

Figure 9:
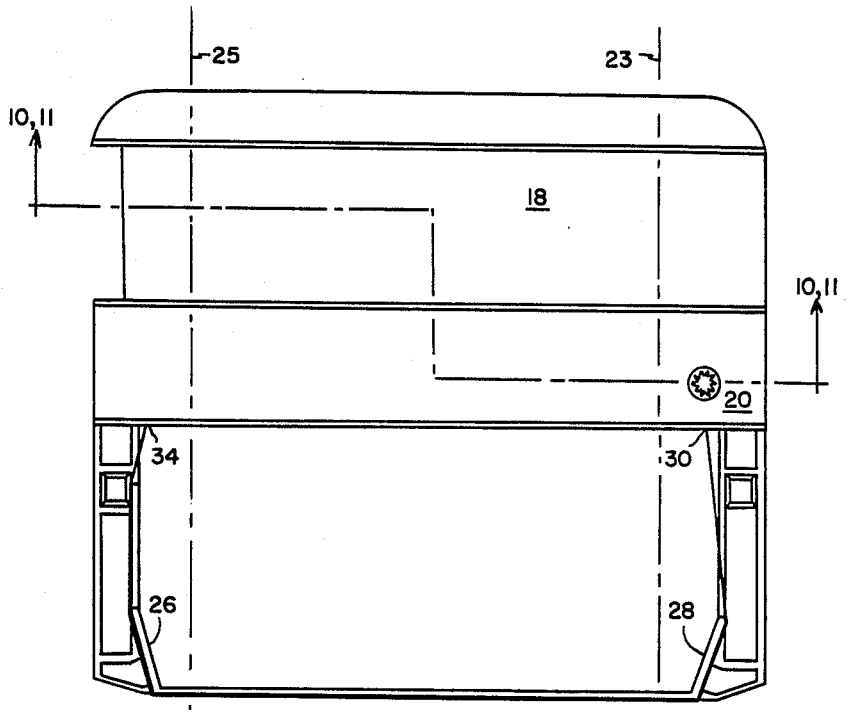
FIG. 9 is a top plan view of the body of another cassette employing the principles of the present invention.

It is to be understood that the cassette may be driven by other drive mechanisms than that discussed above. For example, the drive mechanism may be similar to that disclosed in U.S. Pat. No. 4,209,261 to David W. Bell et al., and which is further shown in FIGS. 9 and 10. In such drive mechanism, it is necessary that the drive wheels be supported on a flat surface in the manner set forth above so that the drive shafts of the printer and cassette be in axial alignment. The drive apparatus 50 consists of a pair of identical roller assemblies 80 and 82 which are positioned adjacent to cavity entrance region 20 (FIGS. 1 and 9). Roller assemblies 80 and 82 cooperate to drive the ribbon through cavity entrance 30 and into the storage cavity. Assemblies 80 and 82 are identical and are positioned adjacent to one another in inverted relation with ribbon 24 passing between them. Roller assembly 80 is the driver mechanism and assembly 82 is then driven mechanism which is driven by the printer.

Figure 10:
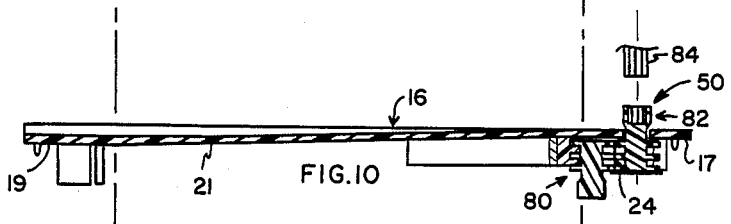
FIGS. 10 and 11 are views similar to FIGS. 7 and 8 taken along lines 10—10 and 11—11 of FIG. 2 and illustrate the top and bottom portions of the cassette.
Figure 11:
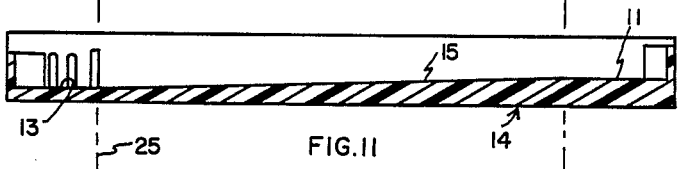

To provide for the angular movement of the ribbon through the printing region and to provide for the vertical mounting of assemblies 80 and 82 in the casing to assure alignment of the output shaft of the printer with the drive shaft of the cassette, the casing cover 16 includes the pair of spaced horizontal surfaces 17 and 19 which are respectively positioned adjacent to opposite sides of the casing. Angled section 21 is disposed between surfaces 17 and 19. Angled section 21 angles downwardly from surface 17 to surface 19 at an angle of approximately 2°. Surfaces 17 and 19 are horizontally disposed with section 17 being in normal relation with the axis of the output shaft of the printer. Base 14 is similarly provided with spaced horizontal surfaces 11 and 13 and intermediate angled surface 15. Surfaces 17, 19, and 21 of upper cover 16 are disposed in substantially parallel relation respectively with surfaces 11, 13, and 15 of base 14. As shown in FIG. 10, assemblies 80 and 82 are mounted to surface 17 of cover 16 with the drive shaft coaxially aligned with printer drive shaft 84.

It is to be understood that while the drawing shows and the description describes the drive shafts of the printer and cassette to be incoaxial alignment, such description is not limiting. For example, the axes of the drive shafts of the cassette and printer may be disposed in parallel spaced relation and each drive shaft provided with intermeshing gears or friction wheels on the ends thereof. Of course, either construction requires that the drive shaft of the cassette be mounted normally to the horizontal surface of the cassette body so that no binding can occur between the drive shafts.

It is to be also understood that while guides 35 and 37 (FIG. 1) are shown and described as rotating the ribbon 180°, such angled guides may be omitted and straight guides provided so that the ribbon may be guided out of cavity 18 without the 180° rotation.

From the foregoing, it is to be appreciated that the ribbon cassette of this invention enables optimum storage of a ribbon from the point of view of feet of ribbon stored in a given cavity size.

Further, this invention enables the provision of an obliquely presented ribbon without distortion of drive assembly linkage, enabling smooth transmission of power between printer and cassette, preventing mechanical binding and reducing wear on the drive components.

What is claimed is:

1. A printing ribbon cassette for a printer having a rotary drive member and comprising:

a body having a cavity therein, said cavity including first and second horizontally spaced horizontal sections disposed at different elevations and an intermediate section extending in obliquely angled relation between said horizontal sections, each end of said intermediate section abutting a said horizontal section, said intermediate section serving as a storage compartment for containing said ribbon, said cavity being defined by a cover and base of said body, said first horizontal section being formed by generally parallel horizontal internal surfaces of said cover and said base, said first horizontal section being disposed adjacent to a first side of said body, said second horizontal section being formed by generally parallel internal horizontal surfaces of said cover and said base, said second horizontal section being disposed adjacent to a second side of said body, said intermediate connecting angled section being formed by generally parallel intermediate internal surfaces of said cover and said base, said generally prallel intermediate surfaces disposed at an oblique angle to the line of printing of said printer and said horizontal surfaces;

an entrance opening in said first horizontal section of said cavity through which said ribbon enters said cavity;

a second opening in communication with said second horizontal section of said cavity and said angled section of said cavity through which said ribbon exits said storage compartment;

ribbon drive means connectable to said rotary drive and disposed in normal relation to a line of printing, said drive means supported in said first horizontal section of said cavity and including a drive shaft in alignment with said rotary drive member for rotation thereby for driving said ribbon into and out of said cavity and for driving said ribbon at an oblique angle past said line of printing, said ribbon drive means including a first rotatable member supported in said first horiziontal section proximate said entrance opening, a second rotatable member supported in said first horizontal section and spaced from said first rotatable member, one of said members being engageable with and driven by said rotary drive member, friction belt means extending over and between said first and second rotatable members for engaging a ribbon and urging it along a generally linear path between said rotatable members, whereby lengths of said ribbon generally equal to said linear path are created, and biasing means for urging a ribbon against said friction belt means, whereby positive engagement is initially made by said ribbon with said frictional belt means; and guide means supported by said body for guiding a ribbon along a path in said body.

2. A printing ribbon cassette as set forth in claim 1 wherein said drive shaft of said drive means is in coaxial alignment with said rotary drive member.

3. A printing ribbon cassette as set forth in claim 2 wherein said guide means includes ribbon reversal means for reversing said ribbon between its passage from said opening and its passage along said generally linear path.

4. A printing ribbon cassette as set forth in claim 3 wherein said guide means comprises first and second ribbon positioning guides wherein said first positioning guide positions the engaged ribbon at a first position with respect to the plane of a line of print of a printer, and said second guide positions the engaged ribbon at a second position with respect to said plane of a line of print, the position of said guides being located to effect movement of said ribbon between said guides at an oblique angle with respect to said plane of a line of printing, and wherein said rotary drive member and said drive shaft of said one of said rotary members is maintained in vertical alignment and a non-binding coupling between printer and cassette is achieved.

5. A printing ribbon cassette as set forth in claim 4 wherein said frictional belt means comprises a pair of second belts.

6. A printing ribbon cassette as set forth in claim 5 wherein said belts are two spaced O cross section flexible belts.

7. A printing ribbon cassette as set forth in claim 6 wherein said cavity employs dimensions of approximately 2 inches by 2.6 inches, and said ribbon is approximately 45 feet in length.

* * * * *